United States Patent [19]

Edwards et al.

[11] 4,019,767

[45] Apr. 26, 1977

[54] QUICKLY ATTACHABLE AND DETACHABLE TINE FRAME FOR A TOBACCO BOX RACK

[76] Inventors: Dalma Therman Edwards; Gene Strickland, both of Springhope, N.C. 27882

[22] Filed: July 22, 1976

[21] Appl. No.: 707,689

[52] U.S. Cl. ..... 294/5.5; 214/5.5; 220/331

[51] Int. Cl.[2] ..... A24B 1/08

[58] Field of Search ..... 294/5.5; 34/236, 237, 34/238, 201; 56/27.5; 131/134, 140 R; 214/5.5; 220/329, 331; 432/500

[56] References Cited

UNITED STATES PATENTS

| | | | |
|---|---|---|---|
| 3,088,603 | 5/1963 | Boyette | 214/5.5 |
| 3,251,620 | 5/1966 | Hassler | 294/5.5 |
| 3,888,533 | 6/1975 | Long | 294/5.5 |
| 3,932,946 | 1/1976 | Johnson | 34/236 X |
| 3,935,959 | 2/1976 | Long | 294/5.5 X |
| 3,948,553 | 4/1976 | Suggs | 294/5.5 |

*Primary Examiner*—Johnny D. Cherry

[57] ABSTRACT

A quickly attachable and detachable tine frame is disclosed for attachment to a tobacco box rack for use in the processing and curing of tobacco leaves. The tine frame is attachable over the open top of the box rack after the box has been filled with tobacco leaves so that separate tines may be inserted through the frame and the tobacco, to hold the tobacco in place when the box rack is tilted on end. The tine frame comprises a pair of spaced longitudinal members and a plurality of longitudinally spaced transverse tine holding bars interconnecting the longitudinal members. A laterally offset longitudinal extension is provided at each end of each of the longitudinal members. A transverse retaining member is provided at each end of the box rack. The tine frame is retained against outward displacement away from the top of the box by the offset longitudinal extensions engaged under the transverse retaining bars at each end of the box. The tine frame may be quickly detached from the box rack by sliding the tine frame to one end of the box, lifting the frame at the other end of the box outwardly, and then sliding the tine frame toward the other end of the box rack until the laterally offset longitudinal extensions are all disengaged from under the top transverse retaining bars at each end of the box rack .

9 Claims, 7 Drawing Figures

QUICKLY ATTACHABLE AND DETACHABLE TINE FRAME FOR A TOBACCO BOX RACK

BACKGROUND OF THE INVENTION

1. Field of the Invention

This invention relates to apparatus for processing and curing tobacco leaves and relates particularly to a quickly attachable and detachable tine frame for a tobacco box rack in which tobacco leaves are stored and held while curing.

2. Description of the Prior Art

Prior to the fall of 1974, bulk tobacco barns utilized what is commonly referred to as a single tier rack such as disclosed in FIGS. 6 and 7 of U.S. Pat. No. 3,105,713 to F. J. Hassler. In the conventional single tier rack, it is seen that the leaves were neatly aligned and supported in a vertical position within the curing and drying structure by the single tier rack. As can be seen from FIG. 5 from the Hassler Patent, the racks were supported transversely in each tier room and in the case of that shown in FIG. 5, the structure was designed to be three tier high with each single tier rack including one leaf length of bulk tobacco and each tier vertically separated within the structure.

In the fall of 1974, both Harrington Manufacturing Company and Long Manufacturing Company introduced what is now referred to as the box type tobacco rack, as shown in the following patents to Long: U.S. Pat. Nos. 3,834,137; 3,888,533; and 3,935,959.

As will be appreciated from a study of the Long Patents and other types of box racks presently being produced, the box rack is first disposed in a fillinng position and tobacco leaves are conveyed in random fashion into an opened top of the container or box and while being filled, the leaves are generally manually or mechanically spread throughout the container. After the container has been appropriately filled, a top or tine frame is placed over the tobacco and attached so as to be securely held about the top portion of the box rack. After this, it is customary to insert a plurality of tines downwardly through the top, or the tine frame, of the box all the way through the volume of tobacco where the entering end of the tines is supported on the bottom or back side by a plurality of angle iron support members or the like.

SUMMARY OF THE INVENTION

The present invention relates to a quick connectable and detachable top tine frame that may be easily attached and detached from the top of a tobacco box rack when the tobacco box rack is oriented in the filling position.

It is an object of this invention to provide a top tine frame for a tobacco box rack which may be quickly attached to and detached from the open top of a box rack without the use of manually operable latches or separable fasteners.

It is a further object of this invention to provide a top tine frame which has hooking members in the form of laterally offset longitudinal extensions at each end which may be engaged with transverse retaining members at opposite ends of a tobacco box rack to secure the tine frame to the open top of the box rack by a sequence of sliding movements of the tine frame relative to the box rack.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings in which like characters of reference are used to designate like parts, and in which.

DESCRIPTION OF THE PREFERRED EMBODIMENT

Figure 1:
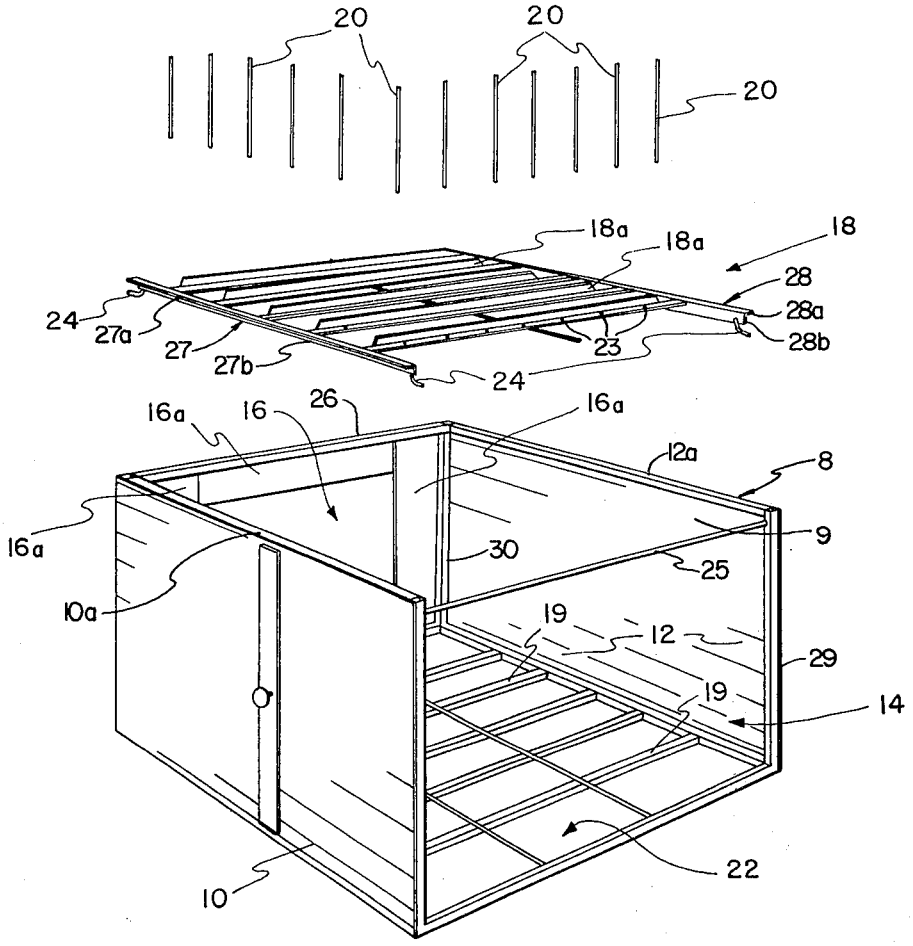
FIG. 1 is an exploded perspective view of a tobacco box rack, the quickly attachable and detachable tine frame of this invention and a plurality of separate tines in disassembled relationship.
Figure 2:
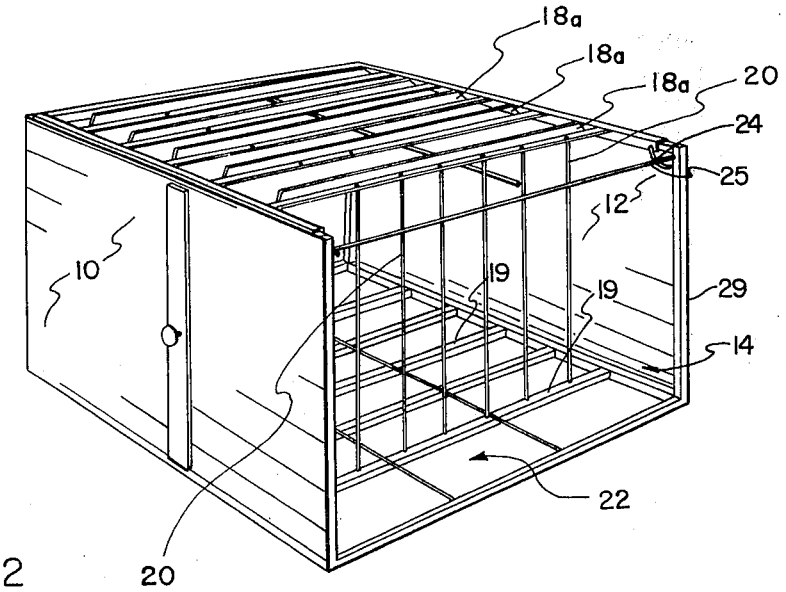
FIG. 2 is a perspective view of the tobacco box rack, the quickly attachable and detachable tine frame of this invention and the tines of FIG. 1 in fully assembled relationship.

Referring to FIGS. 1 and 2, a tobacco box rack for storing and curing tobacco leaves is generally indicated at 8. The box rack 8 includes an open top 9, two opposite sides 10 and 12, the open end 14, the at least partially open other end 16, and a bottom 22. The sides 10 and 12 have linear upper side edge portions **10*a* and 12*a* respectively, and the ends 14 and 16 have top transverse retaining members 25 and 26** respectively.

A top tine frame 18 is provided and adapted to quickly attach and detach to the top of the tobacco box rack 8. When the top tine frame is in the attached position, FIG. 2, it is firmly held to the box rack 8 and a plurality of tines 20 are inserted through openings 23 formed in the transverse tine holding bars **18*a*, and on through the volume of tobacco underlying the tine frame 18**.

Before viewing the tine frame 18 and the attaching structure associated therewith in detail, it should be pointed out that after the tine frame 18 is attached to the box type container 8, the same is rotated as indicated in the Long Patents approximately 90° to where the open end 14 becomes the top of the box rack 8 and the other partially open end 16 becomes the bottom. It is seen that the end 16 includes a series of outer baffle plates **16*a* that tend to restrict the air from moving along the outside areas of the box rack as rotated but generally induces the air to move through the central opening formed therein. The tines 20 project through the entire volume of tobacco within the box rack and the ends thereof normally disposed opposite the tine frame 18 are supported by a series of transversely extending tine support bars 19 that generally form the bottom portion 22 of the box type container 8 as oriented in the filling position as shown in FIGS. 1 and 2**.

Tobacco leaves are placed in the box rack 8 through its open top 9 and they are arranged to lie in generally horizontal planes, while being randomly aligned. After the tine frame 18 has been placed on the box rack 8 and the box rack rotated to an upright position where the end 14 becomes the top and the other former end 16 becomes the bottom, it will be understood that the leaves now assume positions within vertical planes in order that the air may readily pass therethrough. It is in this rotated position that the box rack 8 is oriented during curing and drying as is seen in the Long Patents.

My invention involves providing a quick attaching top tine frame 18. Before my invention, a tine frame was placed on top of a tobacco container and secured thereto by conventional latching means to the side walls or frames of the container. With my invention, the provision of latches as commonly known is avoided completely.

The tine frame 18 of this invention in its preferred form includes two transversely spaced longitudinal members 27,28 and a plurality of longitudinally spaced transverse tine holding bars 18*a* rigidly connected at their opposite ends to the longitudinal members 27,28. The longitudinal members 27,28 are preferably metal angle irons having outwardly extending flanges 27*a* and 28*a* and downwardly extending flanges 27*b* and 28*b* respectively. The longitudinal members 27 and 28 are spaced apart a distance slightly less than the distance between the topside edge portions 10*a* and 12*a* so that when the tine frame 18 is assembled with the box rack 8 as seen in FIG. 2, the downwardly extending flanges 27*b* and 28*b* are adjacent to and slightly inward of the topside edge portions 10*a* and 12*a* respectively and the outwardly extending flanges 27*a* and 28*a* overlie the top edge portions 10*a* and 12*a*. The longitudinal members 27 and 28 are not as long as the side edge portions 10*a* and 12*a*, therefore they can slide upon the top side edge portions between the ends 14 and 16. The rear top transverse retaining member 26 serves as a stop to limit rearward motion of the tine frame 18 toward the end 16 (see FIG. 6), and the front transverse retaining member 25 serves as a stop to limit forward motion of the tine frame toward the end 14 (see FIG. 4).

As viewed in FIG. 1 at both ends of the tine frame 18, there is provided on each side thereof at about the corner positions a curved hooking member 24. The hooking members 24 are formed as downwardly offset longitudinal extensions of the longitudinal members 27 and 28 on each side of the tine frame 18 and they engage under the opposite top transverse retaining members 25 and 26 to secure the tine frame 18 to the box rack 8 in the manner shown in FIG. 2.

Figure 3:
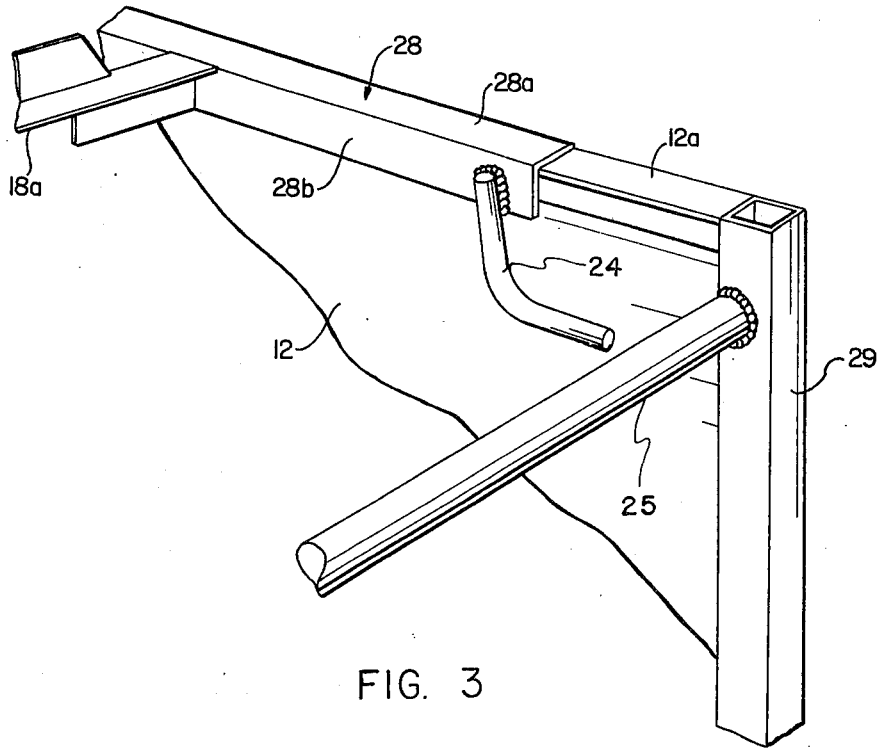
FIG. 3 is an enlarged perspective view of the upper front, right-hand corner portion of the box rack and tine frame of FIG. 1 with the tine frame in position for engaging the front hooking members under the front transverse retaining rod of the box rack.
Figure 4:
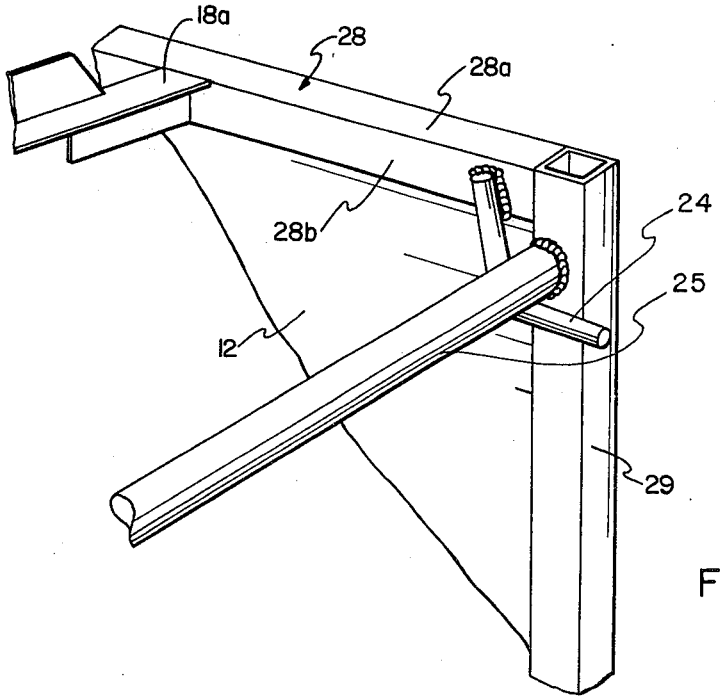
FIG. 4 is a view similar to FIG. 3 but showing the tine frame in its fully forward position.
Figure 5:
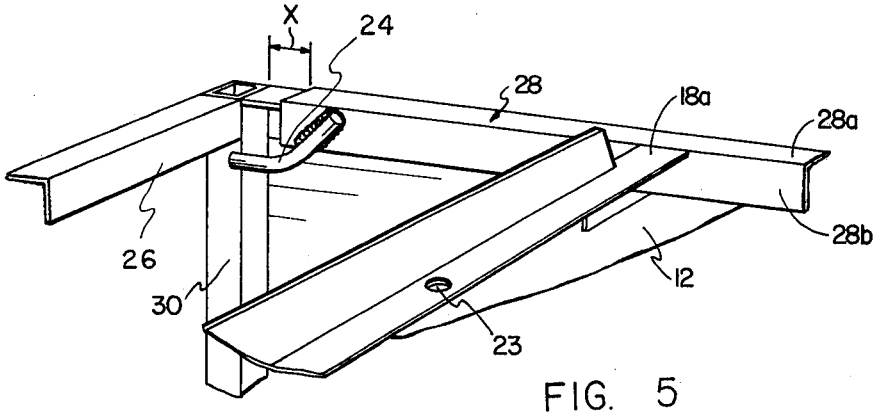
FIG. 5 is an enlarged perspective view of the rear right-hand corner portion of the box rack and tine frame shown in FIG. 2 with the tine frame fully forward corresponding to the position shown in FIG. 4.
Figure 6:
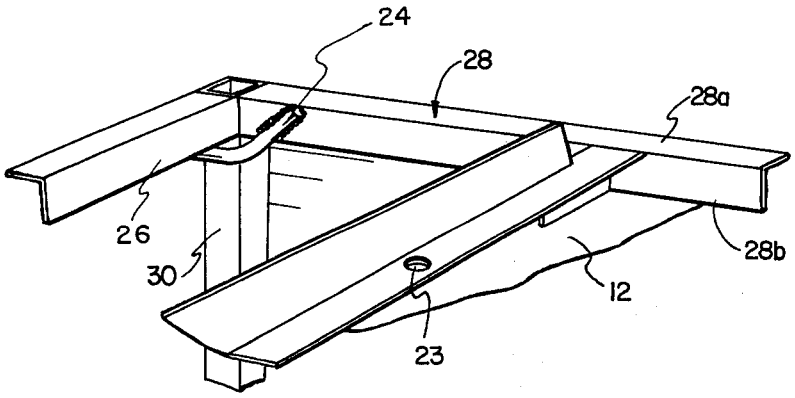
FIG. 6 is a view similar to FIG. 5 but showing the tine frame in its most rearward position.
Figure 7:
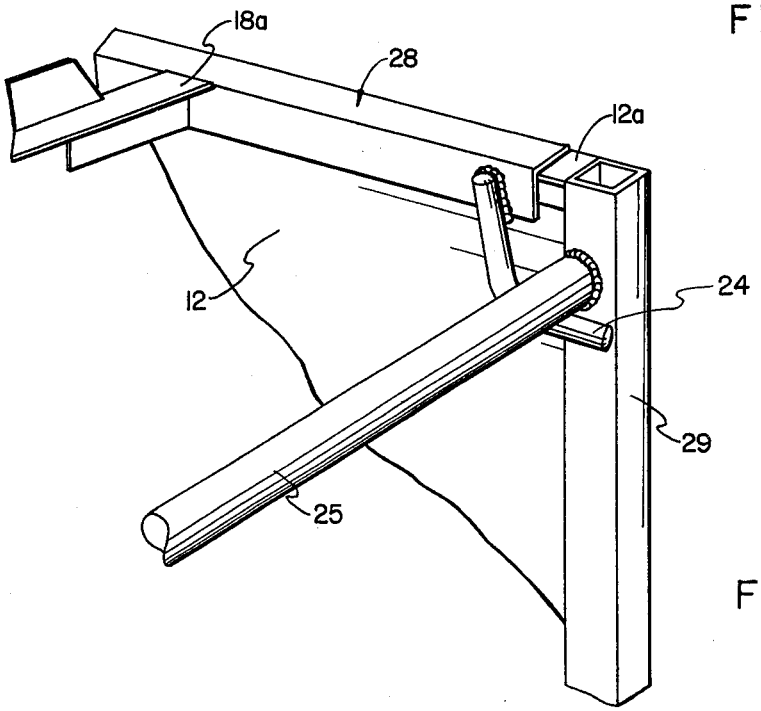
FIG. 7 is a view similar to FIG. 3 but showing the position of the upper front right-hand corner portion of the tine frame when the tine frame is fully attached to the tobacco box rack.

In order to position and attach the tine frame 18 to the box rack 8, the forward portion of the tine frame (as viewed in FIG. 1) is aligned with the top of the box rack (see FIG. 3) and the forward hooking members 24 are pushed to an extreme forward position where the forward hooking members 24 engage underneath the front transverse retaining rod 25 as indicated in FIG. 4. When the time frame 18 is in the extreme forward position, the rear portion of the tine frame can be placed downwardly adjacent the top of the box rack with the rearmost ends of the rear hooking members 24 clearing the rear transverse retaining member 26 as indicated in FIG. 5. After this, the tine frame 18 is slid towards the rear end 16 so that the rear hooking members 24 engage underneath the rear transverse retaining member 26 (FIG. 6). The rear hooking members 24 stop at a point that will assure that the forward hooking members 24 are still secured underneath the front transverse retaining bar 25 (FIG. 7). Consequently when the box rack 8 is rotated 90° to where the end 14 assumes the top position and end 16 the bottom position, the tine frame 18 is held in place in a vertical position. The weight of the tine frame 18 in the vertical position acts to hold the tine frame against the end 16 and thus prevents inadvertent displacement of the tine frame 18 toward the end 14 which would permit disengagement of the now bottom hooking members 24 from the transverse retaining member 26.

To detach the top tine frame 18 from the box rack 8, the reverse process is used. That is, the tine frame 18 is shifted towards end 14 to where the rear hooking members 24 clear the rear retaining bar 26 and the tine frame is then lifted from the top of the container.

It will be recognized that in the embodiment of this invention disclosed herein the distance between the transverse retaining members 25 and 26 (since they are the front and rear stops limiting the front and rear sliding motion of the tine frame) is a primary factor for establishing the longitudinal dimensions of the tine frame to permit the attachment of the tine frame to the box rack in the manner just described. As one criterion, the over-all length of the tine frame between the remote ends of the offset longitudinal extensions 24 at opposite ends of the tine frame must be greater than the distance between the limit stops 25 and 26 at each end of the box rack. A second criterion is that the tine frame be able to slide a limited distance X (see FIG. 5) between stops, and that the offset longitudinal extensions 24 at the end 14 first engaged under the transverse retaining member 25 extend outwardly a distance greater than X from the inner edge of the retaining member when the tine frame is slid forward against the retaining member 25. Thus the sliding of the tine frame away from the retaining bar 25 by the distance X will not withdraw the front longitudinal extensions from under the retaining bar 25. A third criterion is that the tine frame when fully seated against the retaining bar 25 have a longitudinal dimension extending in the direction between the opposite retaining bars 25 and 26 which is slightly less than the distance between the two bars. This is necessary so that the ends of the offset longitudinal extensions 24 adjacent the rear end 16 can clear the rear transverse retaining member 26 when the rear end of the tine frame is lowered against the top of the box rack 8. The tine frame 18 can then be slid rearwardly the distance X to engage the rear offset longitudinal extensions 24 under the rear retaining member 26.

Viewing FIGS. 4 and 5 together which show the front and rear corner portions of the tine frame and box rack with the tine frame slid fully forward it will be observed that the front end of the longitudinal member 28 seats flush with the front vertical corner post 29 and the rear end is spaced from the rear vertical corner post 30 and transverse retaining bar 26 by the distance X. Although not shown, the same is true of the longitudinal member 27. The distance X is the distance between front and rear stops that the tine frame may slide when the longitudinal members 27 and 28 are seated on the upper edge portions 10*a* and 12*a* respectively.

While in the foregoing there has been described and shown a preferred embodiment of the invention, various modifications and equivalents may be resorted to within the spirit and scope of the invention as claimed.

What is claimed is:

1. The combination comprising an open top tobacco box rack for storing and curing tobacco leaves and a quickly attachable and detachable tine frame for attachment over the open top of said box rack, said box rack having a bottom, an open top, a pair of opposite sides and a pair of opposite ends, each of the ends of said pair of ends having a top transverse retaining member connected between said opposite sides, said tine frame having rigid hooking members at opposite ends thereof for sliding engagement beneath the top transverse retaining members at the opposite ends of the box rack for quickly attaching and detaching said tine frame to said box rack over said open top, said tine frame being attachable to said box rack by first sliding the hooking members at one end of the tine frame under the top transverse retaining member at one end of the box until the hooking members at the other end of the tine frame clear the transverse retaining member at the other end of the box rack, lowering the other end of the tine frame until the hooking members at said other end of the tine frame are at a level to just slide beneath the top transverse retaining member at the other end of the box rack and sliding said tine frame at said level toward the other end of the box rack until said hooking members at said other end of tine frame are engaged under the top retaining member at the other end of the box rack.

2. The combination according to claim 1 wherein said tine frame includes a pair of longitudinal members spaced to overlie the opposite sides of the box rack in substantially parallel alignment therewith, and a plurality of longitudinally spaced tine holding bars interconnecting said longitudinal members, said rigid hooking members being formed as downwardly offset longitudinal extensions at opposite ends of each of said longitudinal members.

3. The combination according to claim 2 wherein each of the longitudinal members of said pair of longitudinal members is an angle iron including a depending flange and a right angle flange extending outwardly from said depending flange, said angle irons being spaced to overlie and slide upon the opposite side edges of the box rack with the depending flanges of the angle irons extending downwardly within the box rack adjacent to and parallel to the opposite sides of the box rack.

4. The combination according to claim 2 wherein said tine holding bars have a plurality of apertures spaced along the length thereof to receive tobacco holding tines therein.

5. The combination comprising an open top tobacco box rack for storing and curing tobacco leaves and a quickly attachable and detachable tine frame for attachment over the open top of said box rack, said box rack having a bottom, an open top, a pair of opposite sides and a pair of opposite ends, each of the ends of said pair of ends having a top transverse retaining member connected between said opposite sides, said tine frame having a pair of longitudinal members spaced to overlie said opposite sides of said box rack in substantially parallel alignment therewith, and a plurality of longitudinally spaced tine holder bars interconnecting said longitudinal members, each of said longitudinal members having at each of its opposite ends a downwardly offset longitudinal extension, said extensions being slidably engageable under said transverse retaining members at the opposite ends of said box rack for attaching said tine frame over the open end of said box rack, said longitudinal members exclusive of said extensions each having a length less than the distance between the transverse retaining members at the opposite ends of the box rack so as to permit the tine frame to slide a limited distance between said retaining members, the longitudinal extensions at one end of said tine frame being longer than the limited distance the tine frame can slide while the longitudinal extensions at the other end are slightly less than said limited distance.

6. A quickly attachable and detachable tine frame for attachment to an open top tobacco box rack for storing and curing tobacco leaves, the box rack being of a type having a bottom, an open top, a pair of opposite sides, and a pair of opposite ends, each of the ends of said pair of ends having a top transverse retaining member connected between said opposite sides, said tine frame having rigid hooking members at opposite ends thereof for sliding engagement beneath the top transverse retaining members at the opposite ends of the box rack for quickly attaching and detaching said tine frame to said box rack over said open top, said tine frame being attachable to said box rack by first sliding the hooking members at one end of the tine frame under the top transverse retaining member at one end of the box until the hooking members at the other end of the tine frame clear the transverse retaining member at the other end of the box rack, lowering the other end of the tine frame until the hooking members at said other end of the tine frame are at a level to just slide beneath the top transverse retaining member at the other end of the box rack, and sliding said tine frame at said level toward the other end of the box rack until said hooking members at said other end of tine frame are engaged under the top retaining member at the other end of the box rack.

7. The tine frame according to claim 6 wherein said tine frame includes a pair of longitudinal members spaced to overlie the opposite sides of the box rack in substantially parallel alignment therewith, and a plurality of longitudinally spaced tine holding bars interconnecting said longitudinal members, said rigid hooking members being formed as downwardly offset longitudinal extensions at opposite ends of each of said longitudinal members.

8. The tine frame according to claim 7 wherein each of the longitudinal members of said pair of longitudinal members is an angle iron including a depending flange and a right angle flange extending outwardly from said depending flange, said angle irons being spaced to overlie and slide upon the opposite side edges of the box rack with the depending flanges of the angle irons extending downwardly within the box rack adjacent to and parallel to the opposite sides of the box rack.

9. The tine frame according to claim 7 wherein said tine holding bars have a plurality of apertures spaced along the length thereof to receive tobacco holding tines therein.

* * * * *